US006170943B1

(12) United States Patent
Wen et al.

(10) Patent No.: US 6,170,943 B1
(45) Date of Patent: Jan. 9, 2001

(54) LARGE AND SMALL FORMAT INK JET PRINTING APPARATUS

(75) Inventors: Xin Wen; Henry G. Wirth, both of Rochester, NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/182,351

(22) Filed: Oct. 29, 1998

(51) Int. Cl.[7] ..... B41J 2/01
(52) U.S. Cl. ..... 347/101; 347/105
(58) Field of Search ..... 347/101, 105, 347/104, 36, 44; 400/582, 605, 621, 621.1

(56) References Cited

U.S. PATENT DOCUMENTS

| | | | | |
|---|---|---|---|---|
| 3,946,398 | | 3/1976 | Kyser et al. . | |
| 4,490,728 | | 12/1984 | Vaught et al. . | |
| 5,223,940 | * | 6/1993 | Matsumoto | 400/607 |
| 5,613,415 | * | 3/1997 | Sanpei | 83/36 |
| 5,702,191 | * | 12/1997 | Kakizaki et al. | 400/582 |
| 5,829,897 | * | 11/1998 | Murai | 400/615.2 |
| 6,039,479 | * | 3/2000 | Hill et al. | 400/621 |

FOREIGN PATENT DOCUMENTS 827 833 A2 7/1997 (EP) .

98/08687 3/1998 (WO) .

* cited by examiner

*Primary Examiner*—John S. Hilten
*Assistant Examiner*—Darius N. Cone
(74) *Attorney, Agent, or Firm*—Raymond L. Owens

(57) ABSTRACT

Ink jet printing apparatus for forming a plurality of ink images on a receiver and for cutting the receiver to form separate prints of such ink images in response to a digital image file including at least one digital image, includes at least one ink jet print head adapted to deliver ink to the receiver for moving the ink jet print head in one or more passes to form ink images on a receiver. The receiver is moved along a first receiver path past the ink jet print head. Control circuitry responsive to one or more digital image files for actuating the ink jet print head to form a plurality of ink images on the receiver. A first actuatable receiver cutter responds to the control circuitry and cuts the receiver across the first receiver path. The receiver is moved along a second receiver path that is perpendicular to the first receiver path. A receiver transport shelf is also provided for receiving the receiver sheet after it is cut by the first actuatable receiver cutter; and moves and registers the cut receiver to a second cutting position. A second actuatable cutter responsive to the control circuitry disposed at a second cutting position for sequentially cutting the receiver to form separate prints each having at least one ink image. A print tray is provided for receiving the separate small format prints.

3 Claims, 4 Drawing Sheets

LARGE AND SMALL FORMAT INK JET PRINTING APPARATUS

CROSS REFERENCE TO RELATED APPLICATIONS

Reference is made to commonly assigned U.S. patent application Ser. No. 09/118,538, filed Jul. 17, 1998, entitled "Borderless Ink Jet Printing on Receivers"; commonly assigned U.S. patent application Ser. No. 09/133,879, filed Aug. 14, 1998, entitled "Compensating For Receiver Skew in Ink Jet Printer"; and U.S. patent application Ser. No. 09/182,711, filed concurrently herewith entitled "Format Flexible Ink Jet Printing". The disclosure of these related applications is incorporated herein by reference.

FIELD OF THE INVENTION

The present invention relates to an ink jet printing apparatus that can provide ink images in different size formats on receivers.

BACKGROUND OF THE INVENTION

Ink jet printing has become a prominent contender in the digital output arena because of its non-impact, low-noise characteristics, and its compatibility with plain paper. Ink jet printings avoids the complications of toner transfers and fixing as in electrophotography, and the pressure contact at the printing interface as in thermal resistive printing technologies. Ink jet printing mechanisms includes continuous ink jet or drop-on-demand ink jet. U.S. Pat. No. 3,946,398, which issued to Kyser et al. in 1970, discloses a drop-on-demand ink jet printer which applies a high voltage to a piezoelectric crystal, causing the crystal to bend, applying pressure on an ink reservoir and jetting drops on demand. Piezoelectric ink jet printers can also utilize piezoelectric crystals in push mode, shear mode, and squeeze mode. EP 827 833 A2 and WO 98/08687 disclose a piezoelectric ink jet print head apparatus with reduced crosstalk between channels, improved ink protection, and capability of ejecting variable ink drop size.

Great Britain Patent 2,007,162, which issued to Endo et al. in 1979, discloses an electrothermal drop-on-demand ink jet printer which applies a power pulse to an electrothermal heater which is in thermal contact with water based ink in a nozzle. A small quantity of ink rapidly evaporates, forming a bubble which causes an ink drop to be ejected from small apertures along the edge of the heater substrate. This technology is known as Bubblejet™ (trademark of Canon K. K. of Japan).

U.S. Pat. No. 4,490,728, which issued to Vaught et al. in 1982, discloses an electrothermal drop ejection system which also operates by bubble formation to eject drops in a direction normal to the plane of the heater substrate. As used herein, the term "thermal ink jet" is used to refer to both this system and system commonly known as Bubblejet™.

One advantage of ink jet printing is its capability in printing large-format images. A relatively narrow print head can print a large image on a receiver by scanning across the large printing area in multiple passes. The currently commercial large-format ink jet printers can provide ink images in the widths of 36" to 62". In contrast, a thermal resistive printer utilizes a page-wide print head. The colorants are transferred from a donor web to a receiver at the pressure contact interface between the page-wide print head and the receiver. The manufacturing difficulties and cost make it unfeasible for thermal resistive print head to be wider than a double-page size.

The advancement of ink jet printing technologies has also opened up opportunities in photographic printing for applications in photo minilabs and photo microlabs. In these environments, the ink jet printing techniques have the advantages of easy image manipulation, compatibility with digital image files, and faster turn-around time. When configured properly, ink jet printers can deliver images with qualities comparable to that of the traditional photographs. The typical photographic formats include 3R (3.5"×5"), 4R (4"×6"), page size (8.5"×11") etc. For a given width (e.g. 3.5", 4", 5"), the image length can also vary (e.g. from 5" to 12") from Classic, to HDTV and Panoramic format.

In commercial ink jet printing, it is very desirable to have one ink jet printer to print ink images in both large formats (3'×4') and traditional photographic formats. The service provider can then provide traditional photographs with added digital features and flexibility as well as poster-sizes ink images for displays for home, offices, signage, and graphic art applications.

SUMMARY OF THE INVENTION

An object of the present invention is to provide an ink jet printing apparatus that can effectively provide prints with ink images in small and large formats.

This objects is achieved by ink jet printing apparatus for forming a plurality of ink images on a receiver and for cutting the receiver to form separate prints of such ink images in response to a digital image file including at least one digital image, comprising:

a) means including at least one ink jet print head adapted to deliver ink to the receiver for moving the ink jet print head in one or more passes to form ink images on a receiver;

b) first moving means for moving the receiver along a first receiver path past the ink jet print head;

c) control means responsive to one or more digital image files for actuating the ink jet print head to form a plurality of ink images on the receiver;

d) a first actuatable receiver cutter responsive to the control means for cutting the receiver across the first receiver path;

e) second moving means for moving the receiver along a second receiver path that is perpendicular to the first receiver path and including i) a receiver transport shelf for receiving the receiver sheet after it is cut by the first actuatable receiver cutter; and ii) means for moving and registering the cut receiver to a second cutting position;

f) a second actuatable cutter responsive to the control means disposed at a second cutting position for sequentially cutting the receiver to form separate prints each having at least one ink image; and g) a print tray for receiving the separate small format prints.

ADVANTAGES

An advantage of the present invention is that multiple ink image sizes can be provided by one ink jet printing apparatus which produces both small and large format prints.

DETAILED DESCRIPTION OF THE INVENTION

The present invention is described with relation to an ink jet printing apparatus that can provide ink images in different size formats on receivers.

Figure 1:
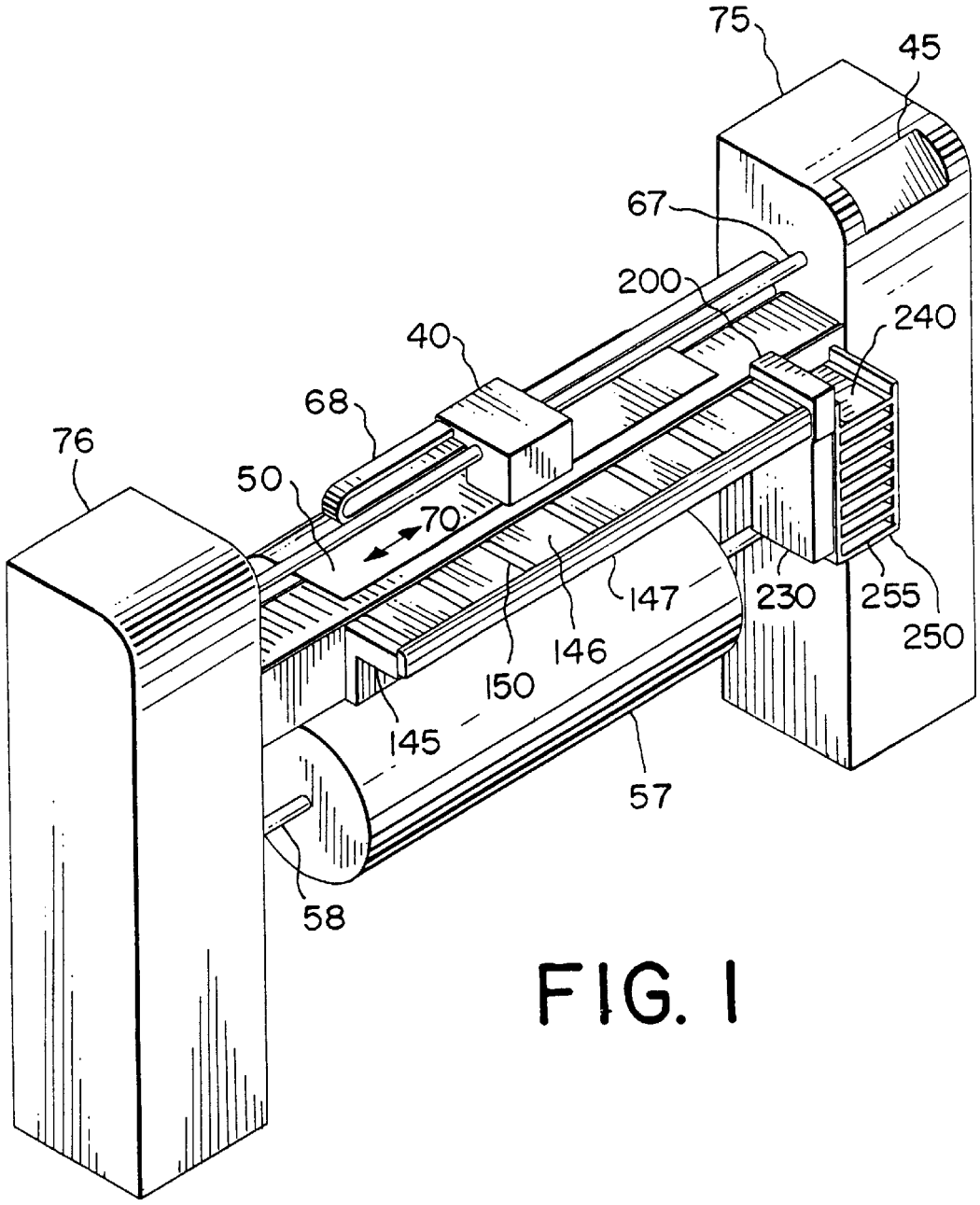
FIG. 1 is a partial perspective of an ink jet printing apparatus in accordance with the present invention.
Figure 2:
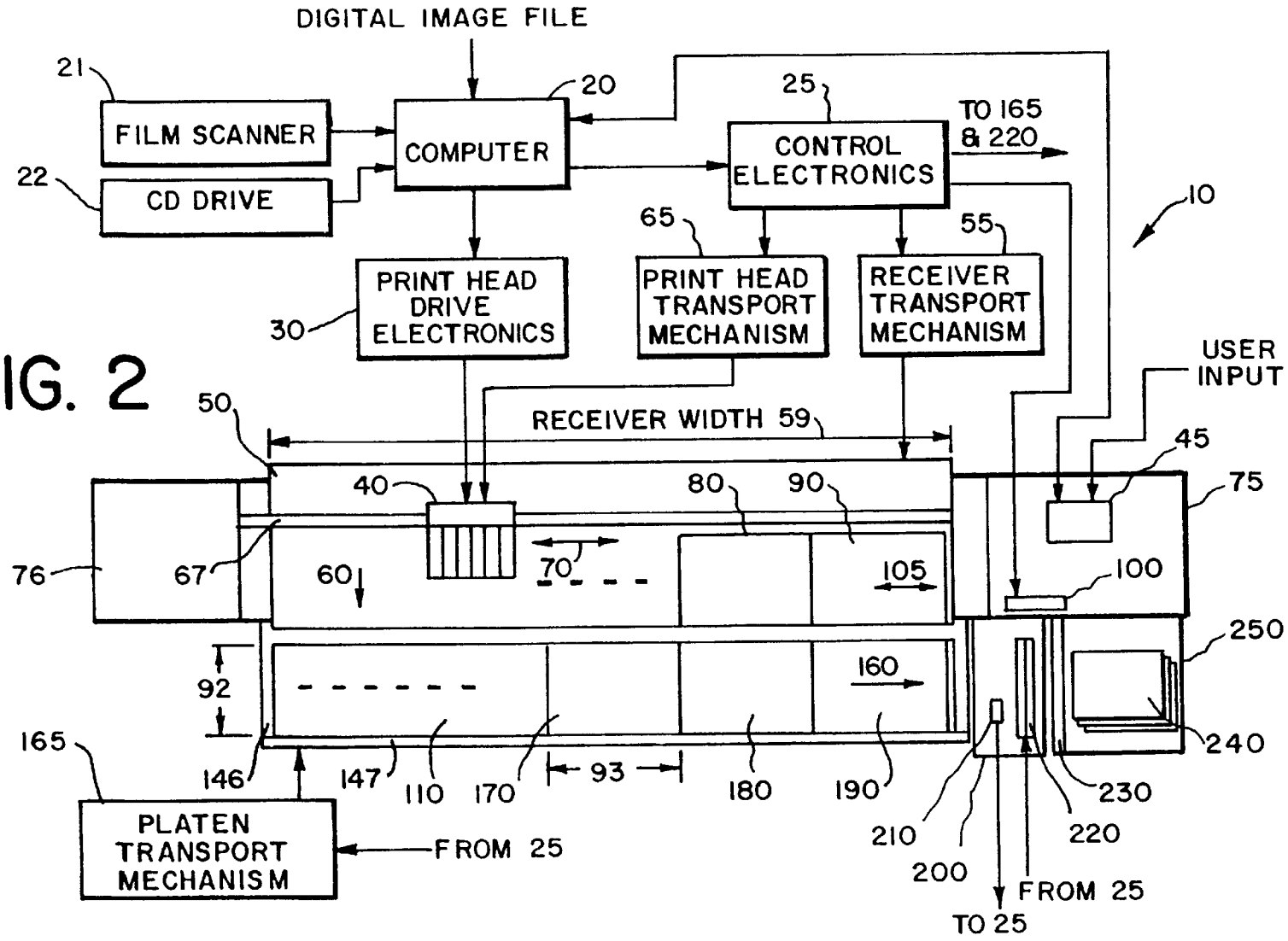
FIG. 2 is a partial top view of the ink jet printing apparatus of FIG. 1.

A partial perspective and a partial top view of an ink jet printing apparatus 10 in accordance with the present invention are shown in FIG. 1 and FIG. 2. For clarity, only the essential components in the ink jet printing apparatus are shown in FIGS. 1 and 2 for illustrating the invention.

Referring to FIGS. 1 and 2, an ink jet printing apparatus 10 comprises a computer 20, a film scanner 21, a compact disk (CD) drive 22, control electronics 25, print head drive electronics 30, a plurality of ink jet print heads 40, a display panel 45, receiver transport mechanism 55, and print head transport mechanism 65. The display panel 45 has a touch-sensitive screen that can both display and receive information input from a user or an operator. The ink jet printing apparatus 10 also includes a right frame housing 75 and a left frame housing 76.

The computer 20 receives a digital image file and input from the display panel 45. The digital image file can be input from a film scanner by scanning a photographic film (e.g. 35 mm, Advanced Photo System, slide film, etc.), or from a CD such as Picture CD, Photo CD, CD-ROM or DVD through the CD Drive 22. The digital image can also be transferred from a digital network or from a digital camera.

The digital image file in the computer 20 can include a plurality of digital images. Each digital image can include several color planes such as yellow, magenta, cyan, and black. The digital image file includes the desired image format to be printed on an ink receiver 50, for each digital image. The image format includes the small formats well known in the art such as 3"×5" (3R), 4"×6" (4R), high definition TV (HDTV), or panorama. The digital image file can also include information such as the time, the location, the scene, exposure conditions, annotations etc. related to each digital image. The digital image file can also include large format digital images such as 11"×17", 3'×4', 4'×5', and other poster sizes. The width of the ink image can span substantially the full width of the receiver 50. The ratio of the length to the width of the print having an ink image is referred as the aspect ratio. A user or an operator can input information such as above to be included in the digital image file using the display panel 45. The user can also input information about the annotation that he or she wants to appear on the ink images.

After receiving the digital image file(s), the computer 20 performs image processing on each individual digital image. As it is well known in the art, the image processing can include re-sizing, tone scale and color calibration, halftoning, swath cutting, and so on. Annotation information will be composed into the digital images as well. In the present invention, a plurality of digital images often need to be composed into a large digital image file. In this way, the ink jet print heads 40 can print a portion from each of several different ink images as the ink jet print heads 40 scan along print head scanning direction 70 in one printing pass. The computer 20 maximizes the packing efficiency of the ink images on the receiver 50 to reduce receiver waste. Those skilled in the art will appreciate, although it is preferable to use a plurality of ink jet print heads, a single ink jet print head can also be used, especially if it is aligned across the print width 92.

The ink jet printing apparatus 10 includes the receiver transport mechanism 55 for moving the receiver 50, in the form of a web, provided by a receiver roll 57 along a first receiver path 60. The receiver roll 57 is wound around a shaft 58. A receiver sensor (not shown) can be provided in a position adjacent to the first receiver path 60 for detecting the lead edge of the receiver 50. Such sensor sends a signal to the control electronics 25 defining the position of the lead edge. The receiver transport mechanism 55 is controlled by the control electronics 25. As shown in FIG. 1, the receiver roll 57 can be easily loaded and off-loaded for receiver change-overs. Receiver rolls of different width can also be loaded. For example, for a 42" wide printer, the receiver roll width can range from 3.5", 4", 8", 10", 17", 20", 36" to 42". A user or operator of the ink jet printing apparatus 10 can provide a user input to the display panel 45 representing the receiver width 59 of the receiver 50 on the receiver roll 57. The computer 20, in response to this receiver width 59, composes digital images and operates the position of the ink jet print heads 40 to form ink images 80 and 90. These images 80 and 90 are properly positioned on the receiver to minimize receiver waste.

The ink jet printing apparatus 10 also includes ink reservoirs (not shown) for providing the colored inks to the ink jet print heads 40. The ink jet printing apparatus 10 can also include print heads and ink reservoirs for printing and storing other color inks such as black, green, red, orange, gold, as well as inks of the same color but of different concentrations such as light cyan and light magenta inks.

The computer 20 controls the print head drive electronics 30 to actuate and thereby cause the ink jet print heads 40 to print color images on a receiver 50. The ink jet print heads 40 can be a unitary structure or each print head can be separate for printing colored inks. Each ink jet print head 40 includes a plurality of ink nozzles and associated ink drop activators for delivering different color ink drops to the receiver 50. The ink jet print heads 40 can be narrow print heads that print across the receiver 50 in a raster or swath fashion. The ink drop ejection can be actuated from the ink nozzles by the ink jet activation means well known in the art, for example, piezoelectric actuators or thermal electric actuators. The ink jet print heads 40 are transported by the print head transport mechanism 65 along the guiding rail 67 under the control of the control electronics 25. The ink jet print head 40 is connected with a flexible connector 68. The flexible connector 68 houses the electric data cables from the print head drive electronics 30 to the ink jet print heads 40 and the ink lines that supply color inks to the ink jet print heads 40. The ink jet print heads 40 scans and prints in print head scanning direction 70 across the first receiver path 60 in one printing pass. The receiver 50 is moved along the first receiver path 60. The next pass is subsequently printed. The ink jet print heads 40 can print either in one direction or bidirectionally. In operation, they are moved across the receiver in each pass. In a bidirectional mode, they are not returned to a home position, but are traversed in a direction opposite to the first pass.

During printing, the print head drive electronics 30 produces signals corresponding to image data from one or more than one digital image files. Each digital image file can include a plurality of digital images. A plurality of ink images (such as duplicates) can also be printed corresponding to each digital image, as defined in the digital image file or by user input to the computer 20 via display panel 45. The ink images 80 and 90 corresponding to these digital images can be conveniently defined to be the same as the formats corresponding to silver halide photographs such as 3.5"×5" (3R), 4"×6" (4R), high definition TV (HDTV) (4"×7"), or panorama (4 ×11.5"). In the present invention, the two dimensions of the ink images 80 and 90 are referred as the print width 92 and the print length 93, as shown in FIG. 2. Preferably, the ink images 80 and 90 that are distributed across the first receiver path will have the same print width 92. The ink images 80 and 90 are distributed on the receiver 50 to minimize the unprinted area to reduce waste. For ink images 80 and 90 of the same print width 92, the print length 93 can vary depending on the specific format of each ink image. For example, the print width 92 of the ink images 80 and 90 can be 4". The 4R, HDTV, and panoramic formats require the print lengths 93 to be 6", 7.5", 10", 11" and 12", respectively.

In accordance with the present invention, the ink jet printing apparatus 10 also includes a first receiver cutter 100 and a second receiver cutter 220. The first receiver cutter 100 and the second receiver cutter 220 are actuatable by the control electronics 25. The first receiver cutter 100 is preferably a cutting wheel, which is commonly in large-format ink jet printers. The second receiver cutter 220 preferably has two spaced apart and parallel blades so that in operation it will cut off the border in between two sequential images at each cut. Those skilled in the art will appreciate that the arrangement can be made so that the distance between blades is adjustable. The first receiver cutter 100 is movable across the receiver 50 along the first cutting direction 105 under the control of control electronics 25. The control electronics 25 can vary the width of the prints and the length of the prints can also be varied by operating the cutters 100 and 220.

A receiver transport shelf 145 is provided at the exit end of the first receiver path 60 for sorting the large and small format prints. On the receiver transport surface 146 of the receiver transport shelf 145, there is provided a plurality of rotatable cone-shaped rollers 150. A receiver registration plate 147 is positioned against the outside edge of the receiver transport surface 146. The receiver registration plate 147 is moved up and down by a platen transport mechanism 165. The cone-shaped rollers 150 are oriented such that the ends of larger-diameter are pointed toward the receiver registration plate 147. When actuated, as described below, these cone-shaped rollers 150 can transport an ink image set 110 along the second receiver path 160 while aligning the ink image set along the receiver registration plate 147.

The receiver registration plate 147 is disposed adjacent to the receiver transport shelf 145 and movable by the receiver platen mechanism 165 between a first blocking position (shown in FIG. 4) for the small format prints to a second unblocking position (shown in FIG. 3) for large format print. The cone-shaped rollers 150 are rotated by a motor and drive mechanism (not shown) which is under the control of platen transport mechanism 165. After the receiver 50 is cut by the first receiver cutter 100, the receiver having the ink image set 110 drops onto the receiver transport surface 146. The platen transport mechanism 165 causes the cone-shaped rollers 150 to register the receiver against the receiver registration plate 147 and advance the receiver to the second receiver cutter 220 where the prints 240 are cut to desired sizes. The prints 240 are then placed into print tray compartments 255 of the print tray 250.

Figure 3:
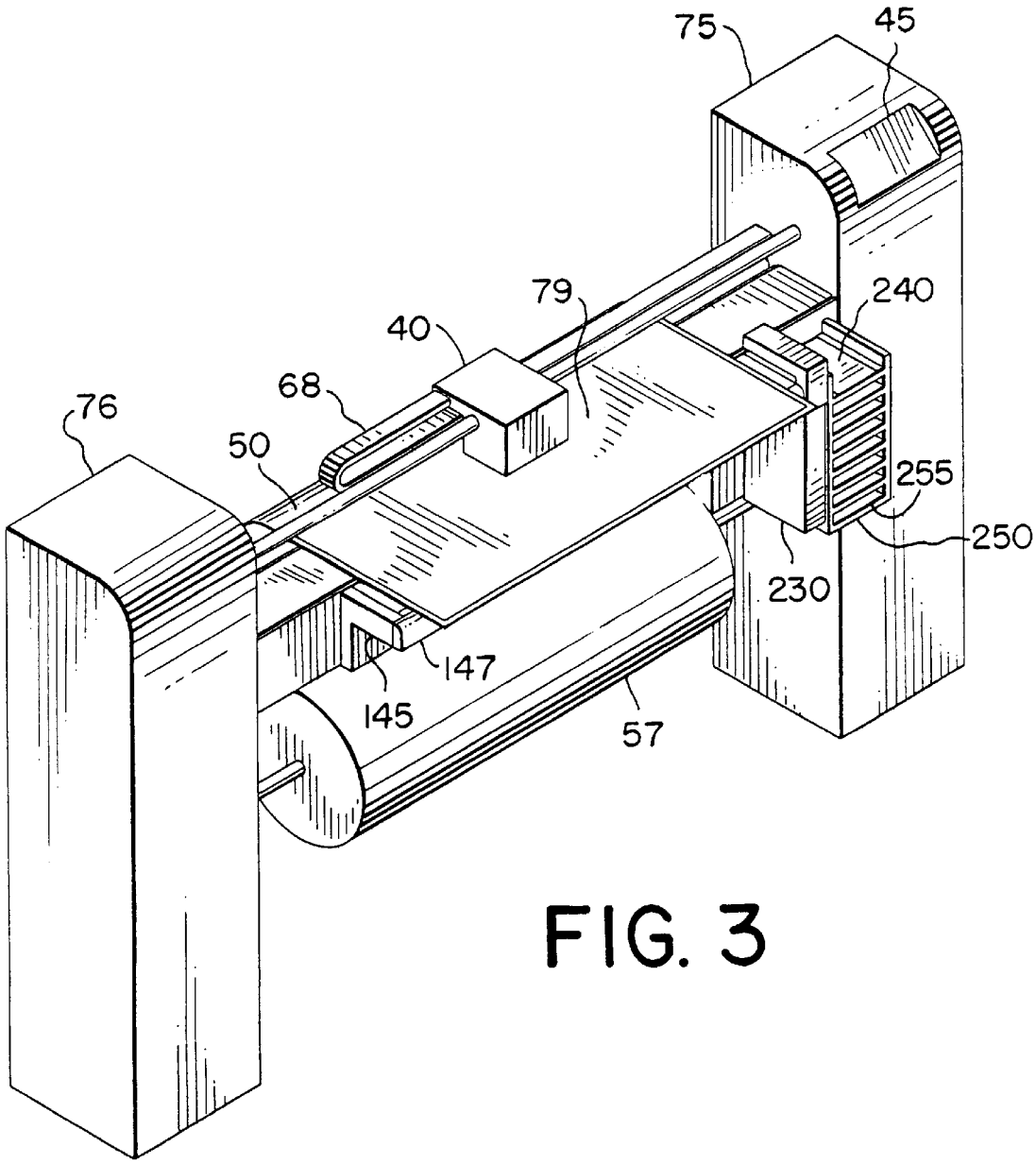
FIG. 3 shows the receiver transport configuration for printing a large format ink image of a full receiver width.

FIG. 3 shows the receiver transport configuration when a large format ink image 79 is in the process of being printed. When a large format ink image 79 of full receiver width 59 is to be printed as defined by a digital image file and the user input, the receiver registration plate 147 is moved down by a platen transport mechanism 165. Receiver 50 carrying the large format ink image 79 is transported passing the receiver transport shelf 145. The receiver 50 large format ink image 79 can then be wound to a roller or dropped to a large receiver tray similar to the commercial large format ink jet printers. It should be noted that the ink jet printing apparatus 10 can print a single digital image on the receiver 50 as a large format ink image as described above.

Figure 4:
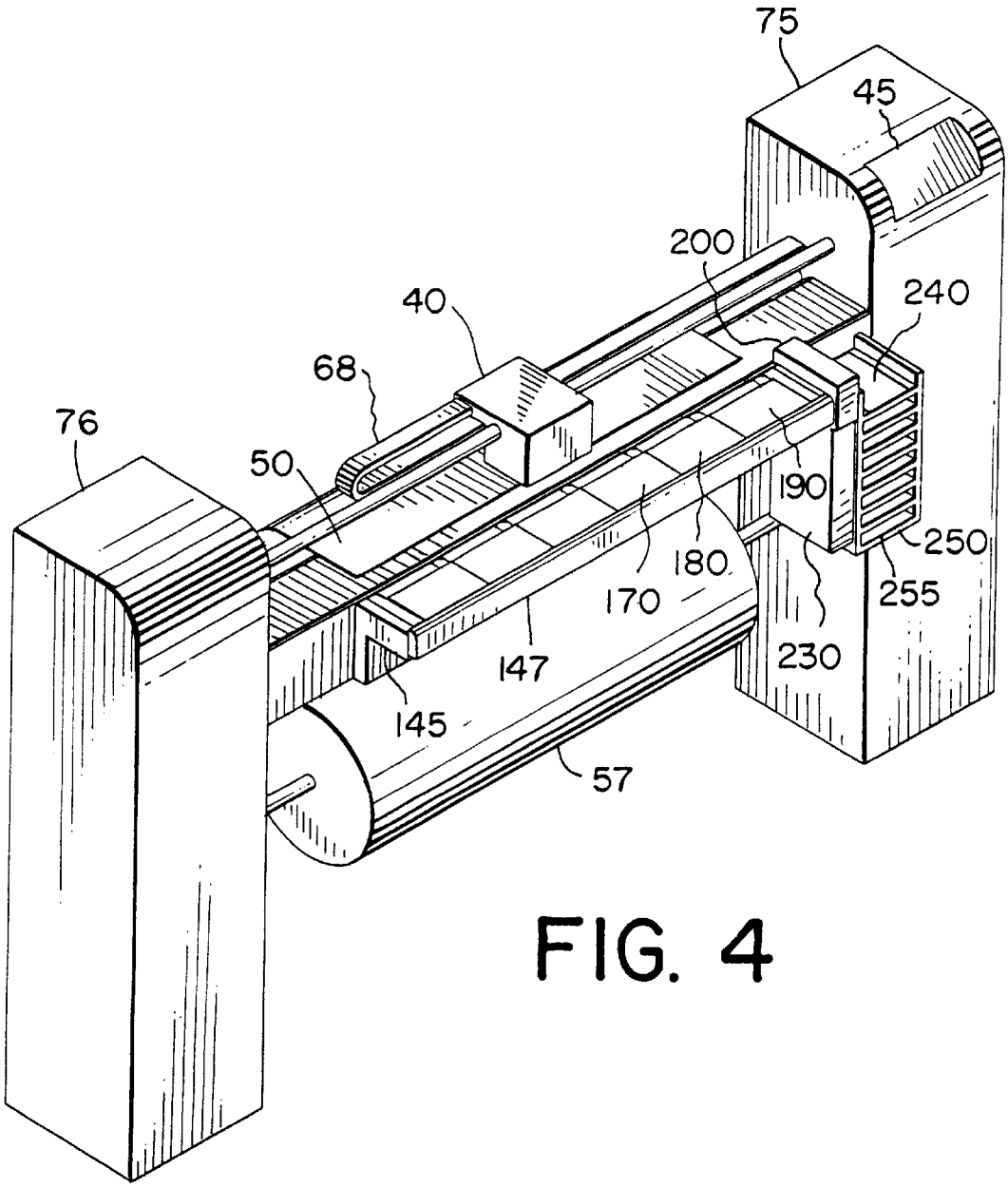
FIG. 4 shows the receiver transport configuration for printing small format ink images.

Now referring to FIGS. 2 and 4, a set of small format ink images 80 and 90 are printed across the first receiver path 60, on the receiver 50. The receiver 50 is cut by the first receiver cutter 100 along the first cutting direction 105 to form ink image set 110. The ink image set 10 preferably includes a plurality of ink images 80 and 90 of the same print width 92. Since borderless prints are often desired for simulating the traditional photograph, the image borders can be cut off along the side of the print lengths of the ink images 80 and 90. Although not shown, the image borders can be dropped to a slug container. Details of borderless printing are also disclosed by the present inventor in the above referenced commonly assigned U.S. patent application Ser. No. 09/118, 538, filed Jul. 17, 1998, entitled "Borderless Ink Jet Printing on Receivers". The ink images 80 and 90 in an ink image set 110 can be separated by unprinted areas across the first receiver path 60. Furthermore, separation marks can also be printed by the ink jet print heads between the ink images 80 and 90. The separation masks can be encoded to carry the information about the length of the ink image following the separation mark along a second receiver path 160 which is perpendicular to the first receiver path 60.

When small format ink images 80 and 90 are printed, according to the digital image file and the user input, the receiver registration plate 147 is moved up by the platen transport mechanism 165. After the first receiver cutter 100 performs its cutting operation, the ink image set 110 is formed on the receiver. The ink image set 110 is shown to include a plurality of ink images 170, 180, 190. The ink image set 110 transferred onto receiver transport shelf 145. The upward positioned receiver registration plate 147 limits the movement of the ink image set 110 in the direction of the first receiver path 60. The cone-shaped rollers 150 are actuated by the platen transport mechanism 165 to move the ink image set 110 along the second receiver path 160. The platen transport mechanism 165 is under the control of the control electronics 25. As described above, the cone-shaped rollers 150 drive the ink image set 110 to be aligned to the receiver registration plate 147 during the movement along the second receiver path 160. If needed, the ink image set 110 can be moved back and forth relative to the second receiver path 160 to move the ink image set 110 to be in contact with the receiver registration plate 147. The ink image set 110 is transported by the cone-shaped rollers 150 to a receiver cutter device 200. The receiver cutter device 200 includes a receiver detector 210 and a second receiver cutter 220.

As the ink image set 110 is moved through the receiver cutter device 200, the receiver detector 210 detects the lead edge of the ink image set 110. The receiver detector 210 can also detect the unprinted area, separation marks, or borders between the ink images 170, 180, and 190. The receiver detector sends signals to control electronics 25 which sends a receiver position signal further to computer 20. The computer 20 calculates the border positions of the ink images 170, 180, 190 of the ink image set 110. The computer

20 then controls the control electronics 25 to actuate the second receiver cutter 220 to sequentially cut the ink image set 110 to remove portions of the receiver between the printed ink images 170–190 as waste and forms the prints 240. The waste or slug is dropped into a slug container 230. In this way, separate prints 240 having ink images of a desired size are formed in response to a digital image file. The prints 240 are placed and stacked in a print tray 250. The print tray 250 can include a plurality of print tray compartments 255, each of which can be used to store a group of prints 240. It is often desired to store the prints 240 from the same customer or prints of the same format size in the same print tray compartment 255.

In accordance with the present invention, as described above, an ink image set 110 comprising a plurality of ink images 170–190 are first formed before individual prints 240 are prepared and stacked. A delay time is therefore provided after the printing operation and the stacking operation. This delay time provides extra time for the ink images 80, 90, 170–190 to dry on the receiver 50, which is beneficial for minimizing image artifacts related to insufficient drying.

An advantage of the present invention is in the flexibility of printing large and small formats is a key advantage of the ink jet printing apparatus 10 in the present invention.

Another advantage in accordance with the present invention is that the printing productivity is increased by long printing pass length. As it is well known in the art, a long printing pass increases the duty cycle of ink jet printing.

The invention has been described in detail with particular reference to certain preferred embodiments thereof, but it will be understood that variations and modifications can be effected within the spirit and scope of the invention.

PARTS LIST

| | |
|---|---|
| 10 | ink jet printing apparatus |
| 20 | computer |
| 21 | film scanner |
| 22 | CD drive |
| 25 | control electronics |
| 30 | print head drive electronics |
| 40 | ink jet print heads |
| 45 | display panel |
| 50 | ink receiver |
| 55 | receiver transport mechanism |
| 57 | receiver roll |
| 58 | shaft |
| 59 | receiver width |
| 60 | first receiver path |
| 65 | print head transport mechanism |
| 67 | guiding rail |
| 68 | flexible connector |
| 70 | print head scanning direction |
| 75 | right frame housing |
| 76 | left frame housing |
| 79 | large format ink image |
| 80 | ink image |
| 90 | ink image |
| 92 | print width |
| 93 | print length |
| 100 | first receiver cutter |
| 105 | first cutting direction |
| 110 | ink image set |
| 145 | receiver transport shelf |
| 146 | receiver transport surface |
| 147 | receiver registration plate |
| 150 | cone-shaped roller |

-continued

PARTS LIST

| | |
|---|---|
| 160 | second receiver path |
| 165 | platen transport mechanism |
| 170 | ink image |
| 180 | ink image |
| 190 | ink image |
| 200 | receiver cutter device |
| 210 | receiver detector |
| 220 | second receiver cutter |
| 230 | slug container |
| 240 | prints |
| 250 | print tray |
| 255 | print tray compartment |

What is claimed is:

1. Ink jet printing apparatus for forming a plurality of ink images on a receiver and for cutting the receiver to form separate prints of such ink images in response to a digital image file including at least one digital image, comprising:

a) means including at least one ink jet print head adapted to deliver ink to the receiver for moving the ink jet print head in one or more passes to form ink images on a receiver;

b) first moving means for moving the receiver along a first receiver path past the ink jet print head;

c) control means responsive to one or more digital image files for actuating the ink jet print head to form a plurality of ink images on the receiver;

d) a first actuatable receiver cutter responsive to the control means for cutting the receiver across the first receiver path;

e) second moving means for moving the receiver along a second receiver path that is perpendicular to the first receiver path and including:

i) a receiver transport shelf for receiving the receiver sheet after it is cut by the first actuatable receiver cutter; and ii) means for moving and registering the cut receiver to a second cutting position, f) a second actuatable cutter responsive to the control means disposed at a second cutting position for sequentially cutting the receiver to form separate prints each having at least one ink image and a slug container disposed adjacent to the second receiver cutter for receiving waste portions of the cut receiver from the second cutter; and g) a print tray for receiving the separate small format prints.

2. The ink jet printing apparatus of claim 1 further including a receiver registration plate disposed adjacent to the receiver transport shelf and movable between a first blocking position for the small format prints to a second unblocking position for large format print.

3. The ink jet printing apparatus of claim 1 wherein the print tray includes a plurality of print tray compartments with each adapted for receiving prints.

* * * * *